United States Patent [19]

Sullivan

[11] 4,365,354

[45] Dec. 28, 1982

[54] RETROREFLECTIVE STRIP WITH POCKET

[76] Inventor: Edith Sullivan, 51 Osgood St., Methuen, Mass. 01844

[21] Appl. No.: 199,571

[22] Filed: Oct. 22, 1980

[51] Int. Cl.[3] ..... A41D 27/20; G02B 5/12

[52] U.S. Cl. ..... 2/247; 2/DIG. 11; 2/171; 350/98

[58] Field of Search ..... 2/247, DIG. 11, 181, 2/171, 185, 422; 350/98

[56] References Cited

U.S. PATENT DOCUMENTS

| | | | |
|---|---|---|---|
| 3,577,561 | 5/1971 | Oshima | 2/422 |
| 3,837,007 | 9/1974 | Girest | 2/126 |
| 3,849,804 | 11/1974 | Rakow | 2/247 |
| 3,901,579 | 8/1975 | Demerest | 350/98 |
| 4,091,766 | 5/1978 | Colliard | 350/98 |
| 4,277,847 | 7/1981 | Florio | 2/DIG. 11 |

FOREIGN PATENT DOCUMENTS

| | | | |
|---|---|---|---|
| 2215831 | 10/1973 | Fed. Rep. of Germany | 350/98 |
| 746722 | 3/1933 | France | 350/98 |
| 462984 | 4/1951 | Italy | 2/171 |

*Primary Examiner*—Doris L. Troutman

*Attorney, Agent, or Firm*—Charles Hieken

[57] ABSTRACT

A retroreflective strip on the outside of a garment encircling a body limb is formed with a pocket formed by another strip of retroreflective material outside the first strip with opposed Velcro fasteners selectively closing the pocket opening.

8 Claims, 1 Drawing Figure

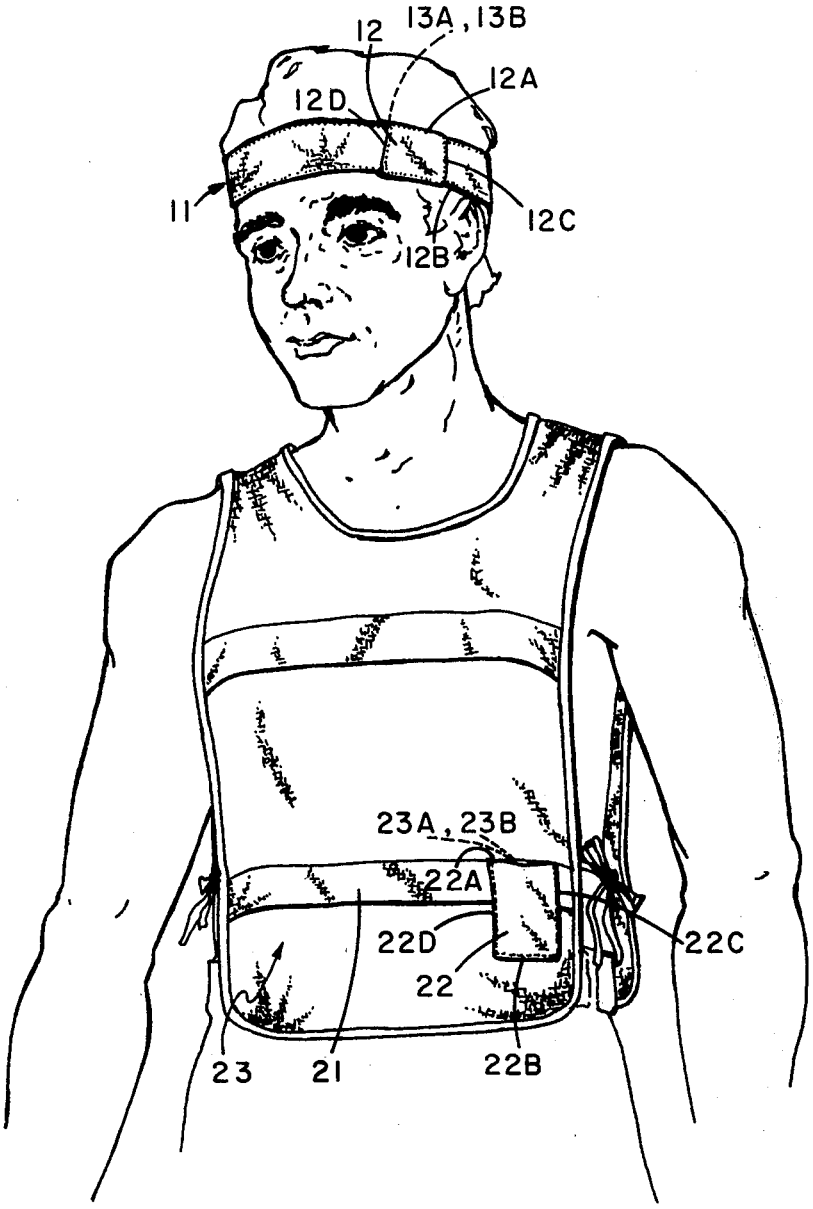
12
13A, 13B
12A
12D
11
12C
12B
23A, 23B
22A
22D
22C
22
23
21
22B

RETROREFLECTIVE STRIP WITH POCKET

The present invention relates in general to storing items in wearing apparel and more particularly concerns novel apparatus and techniques for storing keys, identification or other items by a jogger or other person traveling at night and wearing retroreflective safety strips. Joggers, bicyclists and pedestrians who travel at night can materially enhance their visibility by wearing strips of retroreflective material, such as on vests, arm bands or head bands. It is often desirable to wear a minimum of clothing when exercising, yet it is often necessary or desirable to carry a key or an identification. Carrying a key on a chain or string around the neck may be distracting and uncomfortable while moving. Putting a key in a conventional pocket may result in losing it while moving. And putting an identification in a conventional pocket may result in its deterioration from sweat penetrating the pocket. Furthermore, the person may forget to carry the key or identification.

Accordingly, it is an important object of this invention to provide improved methods and means for carrying items by a person moving at night.

It is another object of the invention to achieve the preceding object while overcoming one or more of the disadvantages enumerated above.

It is another object of the invention to provide a convenient pocket on a retroreflective strip for securely storing and protecting a key, identification or other item while minimizing the chances of damage.

It is another object of the invention to achieve one or more of the preceding objects while negligibly inconveniencing the wearer.

According to the invention, there is a strip of retroreflective material having another shorter strip of retroreflective material secured thereto along edges to form a pocket having an opening perpendicular to the length of the retroreflective strip. Velcro (loop-hook) or other suitable fasteners may be used to selectively close the pocket open end.

Numerous other features, objects and advantages of the invention will become apparent from the following specification when read in connection with the accompanying drawing the single FIGURE of which shows a perspective view of pockets according to the invention on a retroreflective headband and a retroreflective strip attached to a vest.

With reference now to the drawing there is shown a perspective view of an embodiment of the invention in which a retroreflective headband (or armband) 11 has secured thereto a strip of retroreflective material stitched along edges 12A, 12B and 12C to form a pocket having an opening along edge 12D that may securely accommodate a key and/or identification slip that a jogger, bicyclist or pedestrian may carry while wearing the headband or armband at night. Opposed Velcro strips 13A and 13B selectively close the opening along edge 12D. The wearer may keep the items in the pocket to minimize the chances of forgetting them when moving at night. By locating the pocket outside the main body of retroreflective material, the contents of the pocket are protected from perspiration of the wearer. By making the added rectangle of retroreflective material as shown, there is no reduction in retroreflective effect of the retroreflective band.

There is also shown another embodiment of the invention in which a retroreflective strip 21 is secured to a light jogging jersey 23 and carries a pocket 22 oriented with an opening at the top 22A and secured along edges 22B, 22C and 22D to the jersey 23 and strip 21. Opposed Velcro strips 23A and 23B selectively close the opening along the top 22A. Pocket 22 is also made of retroreflective material so that the retroreflective effect of strip 21 is not reduced by the pocket, and is in fact enhanced, by making the height of pocket 22 greater than the width of strip 21, thereby also increasing the pocket capacity. This pocket retains the advantages enumerated above for pocket 12.

There has been described novel structure and techniques for providing a convenient means of protecting small items, such as keys or identification, by a person moving at night while protecting the person with retroreflective strips that enhance the visibility of the person. It is evident that those skilled in the art may now make numerous uses and modifications of and departures from the specific embodiments described herein without departing from the inventive concepts.

Consequently, the invention is to be construed as embracing each and every novel feature and novel combination of features present in or possessed by the apparatus and techniques herein disclosed and limited solely by the spirit and scope of the appended claims.

What is claimed is:

1. In wearing apparel having a retroreflective strip of material the improvement comprising, a portion of retroreflective material secured to said retroreflective strip on the outside thereof and coacting therewith to form a pocket having an opening for accommodating small items and means including an area of said retroreflective strip of material for assisting in protecting the small items from perspiration of the wearer.

2. The improvement in accordance with claim 1 wherein said portion is of substantially the same width as said strip and secured thereto along three adjacent edges thereof.

3. The improvement in accordance with claim 2 wherein the open edge of said pocket is substantially orthogonal to the length of said strip.

4. The improvement in accordance with claim 3 wherein said retroreflective strip comprises an armband or headband.

5. The improvement in accordance with claim 1 wherein the open edge of said portion is generally parallel to the length of said strip.

6. The improvement in accordance with claim 5 wherein the height of said portion is greater than the width of said strip.

7. The improvement in accordance with claim 1 and further comprising means for selectively closing said opening.

8. The improvement in accordance with claim 7 wherein said means for selectively closing comprises opposed loop-hook fastener strips.

* * * * *